US007246761B2

(12) United States Patent
Hoppe et al.

(10) Patent No.: US 7,246,761 B2
(45) Date of Patent: Jul. 24, 2007

(54) PROCESS REACTOR AND METHOD FOR THE ELECTRODYNAMIC FRAGMENTATION

(75) Inventors: Peter Hoppe, Stutensee (DE); Josef Singer, Eggenstein-Leopoldshafen (DE); Harald Giese, Stutensee (DE); Peter Stemmermann, Karlsruhe (DE); Uwe Schweike, Karlsruhe (DE); Wolfram Edinger, Karlsruhe (DE)

(73) Assignee: Forschungszentrum Karlsruhe, Karlsruhe (DE)

( * ) Notice: Subject to any disclaimer, the term of this patent is extended or adjusted under 35 U.S.C. 154(b) by 35 days.

(21) Appl. No.: 11/351,629

(22) Filed: Feb. 10, 2006

(65) Prior Publication Data

US 2006/0163392 A1 Jul. 27, 2006

Related U.S. Application Data

(63) Continuation-in-part of application No. PCT/EP2004/008802, filed on Aug. 6, 2004.

(30) Foreign Application Priority Data

Oct. 8, 2003 (DE) ..... 103 46 650

(51) Int. Cl.
*B02C 19/18* (2006.01)
*B02C 19/00* (2006.01)

(52) U.S. Cl. ..... 241/1; 241/24.12; 241/24.14; 241/46.01; 241/301; 166/248

(58) Field of Classification Search ..... 241/1, 241/24.12, 24.14, 46.01, 301; 166/248
See application file for complete search history.

(56) References Cited

U.S. PATENT DOCUMENTS

| | | | | |
|---|---|---|---|---|
| 3,207,447 | A | 9/1965 | Whitham | |
| 3,715,082 | A * | 2/1973 | Carley-Macauly et al. | 241/1 |
| 3,749,958 | A * | 7/1973 | Ward | 313/146 |
| 4,313,573 | A * | 2/1982 | Goldberger et al. | 241/1 |
| 4,540,127 | A * | 9/1985 | Andres | 241/1 |
| 4,653,697 | A * | 3/1987 | Codina | 241/1 |
| 5,758,831 | A * | 6/1998 | Collins et al. | 241/1 |
| 5,795,466 | A * | 8/1998 | Kelebek et al. | 209/166 |
| 6,039,274 | A * | 3/2000 | Zinoviev et al. | 241/1 |

FOREIGN PATENT DOCUMENTS

| | | |
|---|---|---|
| DE | 195 34 232 | 3/1997 |
| FR | 1 341 851 | 12/1962 |

* cited by examiner

*Primary Examiner*—Derris H. Banks
*Assistant Examiner*—Jason Y. Pahng
(74) *Attorney, Agent, or Firm*—Klaus J. Bach

(57) ABSTRACT

In a process reactor and a method for the electro-dynamic fragmentation of lumpy mineral materials by pulsed high voltage discharges, including a reaction chamber with a funnel-like bottom having a central outlet, an axially movable high-voltage electrode extending from the top into the reaction chamber and having a front end disposed opposite the central outlet where another electrode which is at an electric reference potential is disposed, the outlet converges into a tailback tube below which a transport unit for the controlled removal of the processed fragmented material sinking down through the tailback tube is disposed, a material supply arrangement extends to an opening in the wall of the reaction chamber and a material flow blocking structure is disposed in the reaction in front of the material inlet opening for controlling the material admission to, and the fill level in, the reaction chamber.

10 Claims, 1 Drawing Sheet

PROCESS REACTOR AND METHOD FOR THE ELECTRODYNAMIC FRAGMENTATION

This is a continuation-in-part application of international patent application PCT/EP2004/008802 filed 6, Aug. 2004 and claiming the priority of German patent application 103 46 650.9 filed 8 Oct. 2003.

BACKGROUND OF THE INVENTION

The invention relates to a process reactor for the electro-dynamic fragmentation of particulate mineral materials immersed in a processing fluid by pulsed high-voltage discharges and a method for operating the process reactor.

In its basic design, such a process reactor comprises: A closed reaction chamber with a funnel-like bottom including a central outlet. An electrode to which a high voltage can be applied, that is a high voltage electrode, extends from the top into the reaction chamber. This electrode is surrounded by an electrical insulation except for a free end area thereof. The high voltage electrode is movable along the axis thereof so that its end is disposed opposite the central outlet at the funnel-like bottom of the reaction chamber which outlet has a circumferential metallic edge that forms the opposite electrode which is at an electrical reference potential. Material is supplied to the reaction chamber for fractioning continuously or batch-wise by way of an opening in the wall of the reaction chamber.

The majority of the known fragmentation devices are operated batch-wise, or, in the language as used by the persons skilled in the art, in a batch-mode, that is, a small amount in the order of several kilograms of the material to be treated is introduced into the process space usually by hand and deposited above the reference electrode, generally on a perforated bottom wall (sieve) and is fragmented there by high voltage discharges. When the desired number of discharges has been reached, the materials that have passed through the sieve and the material remaining on the sieve can be discharged separately. A typical representative of the mode of operation is the Franka-O-plant of DE 195 34 232 C2 (FIGS. 5, 6) or, respectively, similar plants as they are described for example in publication [1].

For industrially relevant throughputs a batch-mode however is not particularly suitable. The apparatus disclosed in [2] is for a continuous supply of material but, because of the sieve used, it is not suitable for relatively large mass-throughputs.

U.S. Pat. No. 6,039,274 (FIG. 1) also discloses a continuous material flow in connection with a sieve or, respectively, a vibration sieve; however, there are unsolved points, that is, the throughput, the treatment duration and the life of the sieve.

The continuously operating processes patented in DE 197 27 534 C2 and GB 1 284 426 are based on the use of the electro-hydraulic principle, that is, the effects of the shock waves resulting from an underwater HV-discharge. Generally, it can be said that an important weak point of all apparatus concerns the sieve bottom in the process chamber which allows only a relatively small throughput volume and the largest added component which is allowed to leave the process area is always smaller than the mesh width of the sieve. In praxis, the conditions are even less favorable: If a component part is freed from the material and if that part is not disposed above an opening in the sieve bottom but reaches that location only after several more discharges it can be subjected to one or more additional fragmentation actions. This effect however is not desirable if, in addition to the basic requirement for fragmentation, the components should maintain a certain size which, in a heterogeneous material, may play an important role. As an example, the segregation of concrete into its constituents is referred to where the operation over a sieve electrode will inevitably result in an undesirable shift of the gram size distribution curve (grading curve) of the regained aggregate (gravel) towards smaller particle size. A direct mixing of new concrete on the basis of this recycled aggregate is therefore not possible. If such a grading curve shift or the undesirable fractioning procedure is to be avoided, a sieve with a larger number of openings and larger diameter openings must be used. However, with sieves having a larger number of openings, the probability of sieve failure or fractures increases and, with sieves having larger openings not only the material components of the desired size, but also smaller components with residual attachments of the cement matrix and matrix conglomerates pass through the openings. This again is contrary to the requirement for a separation of the components which is to be as complete as possible.

Sieves, furthermore, have the important disadvantage that they all have a tendency to clog as a result of foreign materials in the concrete waste, such as nails or reinforcement residues which detrimentally affect the operability of a technical plant.

It is therefore the principal object of the present invention to provide a process reactor for a preferably continuous and efficient electro-dynamic fragmentation of brittle particulate mineral materials for industrial relevant mass throughputs.

SUMMARY OF THE INVENTION

In a process reactor and a method for the electro-dynamic fragmentation of lumpy mineral materials by pulsed high voltage discharges, including a reaction chamber with a funnel-like bottom having a central outlet, an axially movable high-voltage electrode extending from the top into the reaction chamber and having a front end disposed opposite the central outlet where another electrode which is at an electric reference potential is disposed, the outlet converges into a tailback tube below which a transport unit for the controlled removal of the processed fragmented material sinking down through the tailback tube is disposed, a material supply arrangement extends to an opening in the wall of the reaction chamber and a material flow blocking structure is disposed in the reaction chamber in front of the material inlet opening for controlling the material admission to, and the fill level in, the reaction chamber.

The outlet at the funnel-like bottom extends to a tailback tube below which a transport unit for the removal of the material is disposed which carries the processed fragmented material moving down through the tailback tube away. In the openings of the wall of the reaction chamber, the end of a material supply arrangement is disposed by which material to be fragmented is supplied to the reaction chamber. In the reaction chamber a material flow blocking structure is disposed in front of the material input opening, whereby the material supply flow and the fill level in the reaction space is controlled.

Preferably, the average residence time $T_M$ of the material in the reaction zone is controlled by the speed of the material removal through the tailback tube below the reaction zone. This speed is determined by the discharge area $A_u$ at the tailback tube exit, the adjustable distance a between the bottom opening of the tailback tube and the material removal/transport unit and the speed $V_o$ thereof. From the combination of these parameters, the transport rate dV/dt is obtained. The length l of the tailback tube is so selected that, during fragmentation, a stable angle of repose of the fragmented good falling onto the transport unit is formed. Finally, the degree of fragmentation of the processed material is adjusted by the average number of high-voltage pulses n, to which the material in the reaction zone is subjected and the transport rate dV/dt as well as the amount of energy applied to the material with each high voltage pulse and the pulse frequency f of the high voltage pulses.

Advantageously, the central outlet of the funnel-like bottom is a metallic tailback tube which includes an upper inlet area $A_o$, a lower outlet area $A_u$, and the area relationship $A_o<A_n$. This outlet has a conical rim and fits flush and smoothly to the conical part of the funnel-like bottom. The metallic rim of the outlet forms the counter-electrode in the two-electrode system of the process reactor and is connected to a reference potential, generally ground potential. If the cross-section is circular, that is, the tailback tube extends vertically, the diameter and the cross-section have the relationship $A=nd^2/4$. Generally, the tailback tube may have a circular or polygonal cross-section and may extend from the reactor vertically or at a sloping angle. On the funnel-like bottom the metallic wall of the reaction chamber is disposed which is connected to the same reference potential as the backup tube.

The tailback tube extends vertically or at a slope angle to a discharge channel and is disposed above the transport unit for the removal of the material with an adjustable distance a.

A material supply device by which the goods to be fragmented is introduced into the reaction chamber extends into the opening of the wall of the reactor container.

A material flow blocking structure is disposed in, or extends into, the reaction chamber for controlling the material fill level or the material supply volume.

The high voltage electrode consists of electrically conductive material which is only slowly consumable. The high voltage electrode may be a massive body or it may be tubular, that is, hollow cylindrical with a round or polygonal cross-section.

The front end with the average diameter de is disposed parallel and opposite to the conical opening at the tailback tube while forming a conical annular gap between the high voltage electrode and the reference potential electrode with the circumferentially constant width g, and, together therewith, forms the conical annular reaction zone for the fragmentation.

The material supply arrangement comprises for example a vibration structure or a transport belt. The material flow blocking structure in the reaction chamber is for example a height adjustable baffle which is supported so as to be movable along the wall of the reaction chamber and which, in the closed position, contacts with its bottom edge the reaction chamber or is supported thereon. On the other hand, the flow blocking structure may be a horizontal or helical group of at least one chute or tube extending around the inner wall of the reaction chamber along the bottom line of which there are holes from each of which a down-pipe with an open diameter of at least the open width of the diameter of the hole extends so that material passing therethrough cannot get stuck. The down-pipes run downwardly adjacent the reactor wall and extend to the actual reaction volume.

As transport unit the following may be used for example:

A disc may be used on which the fragmented material is deposited and rotated away and then moved off the disc by a collecting plate. Alternatively, a transport belt may be employed for that purpose.

The start of the discharge channels at the two electrodes is decisive for a reliable long-time operation of the fragmentation apparatus. Discharge channels should not always start at a fixed point of the electrode surface, but start points should be statistically evenly distributed over a predetermined area of the electrode surface. Two surface conditions can be helpful in this respect, that is, the annular front area of the high voltage electrode has in the desired start area of the discharge channels a smooth surface or a surface which is roughened in such a way that its shape causes a uniform local increase of the electrical field.

With the electro-dynamic fragmentation process high voltage discharges are used. The electrical discharges in this regime pass mostly through the material to be fragmented and not through the process fluid around the material.

The process reactor fulfills the following requirements:

It provides for a continuous and controlled addition and removal of the material to be fragmented to, and from, the reaction volume, The arrangement of high-voltage and ground electrodes is such that large material flows can be achieved.

With these measures, the following advantages are achieved:

The charge level in the process reactor is maintained constant. This is an essential point since upon failure of the material flow blocking structure, the process reactor would be rapidly filled up with the successively delivered material which would be added faster than it is treated and removed—a scenario which can easily occur with such operational breakdowns. This would have two disadvantageous effects:

First, the material flow in the process space would be detrimentally affected by an overload of material volume. During treatment by exposure to the shockwaves, the material cannot freely move around with each pulse so that the fragmentation is less uniform.

Second, it has been found that the excessive charge of the reaction space with added material causes the formation of cavities, that is, a so-called silo-effect. By forming a stable vault ceiling, these cavities at times have such a high stability that the material transport is completely inhibited.

The average residence time of the material to be fragmented is controlled so as to achieve the desired degree of fragmentation by an average number of discharges per mass unit of the material moved through the reaction spaces.

The fragmented material is removed from the reaction space in a controlled and continuous way.

The design of the electrode geometry has the following advantages:

the high voltage discharges pass preferably through the material to be fragmented; the material is electro-dynamically fragmented, that is, the discharge path through the material first causes the material to explode and the following shockwave causes further fragmenting of the material as a result of external effects.

No discharges occur at the surface of the isolation structure of the high voltage electrodes.

Corresponding field stress relief design features as described in DE 101 26 646 A1 are provided for in the area of the insulation end of the high voltage electrode by the shape thereof.

In comparison with the usually employed cylindrical HV-electrodes which are disposed opposite a grounded plate or a perforated bottom at a distance of about 20 to 40 mm (see DE 195 34 232 C2), the electrode arrangement as presented herein has the following advantages:

The reaction space is with the same electrode spacing—substantially larger because of its annular conical form so that more material can be carried through the reaction space and treated therein, The burn-off of the electrodes is reduced because of their larger surface area and the uniform distribution of discharge over the circumference thereof.

The ground electrode, that is, the tailback tube does not include sieve-like structures with the associated problems of mechanical instability and blockages.

electrode burn-off is compensated for by a vertical displacement in Z direction of the HV electrode together with the insulator 2 thereof and consequently also the electrode spacing g is adapted to optimal process parameters:

because of the stochastic nature of both the distribution of the material lumps in the reaction zone and the discharge path location, the tailback tube forms the ground electrode and the ground electrode therefore also has an axially extending structure.

Below, the process reactor design will be described in greater detail on the basis of the accompanying drawings.

DESCRIPTION OF A PREFERRED EMBODIMENT

Figure 1:
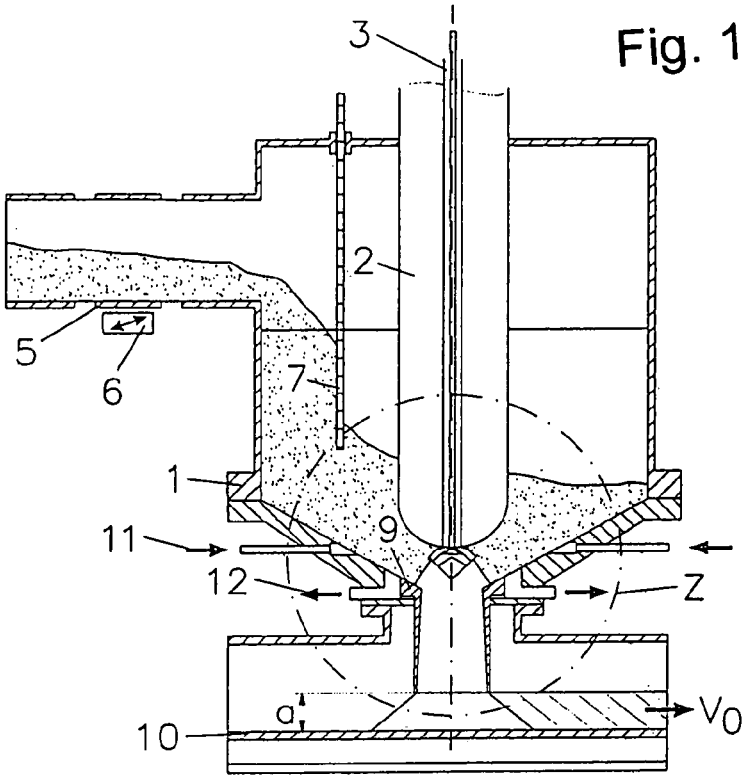
FIG. 1 shows the process reactor in an axial cross-section.
Figure 2:
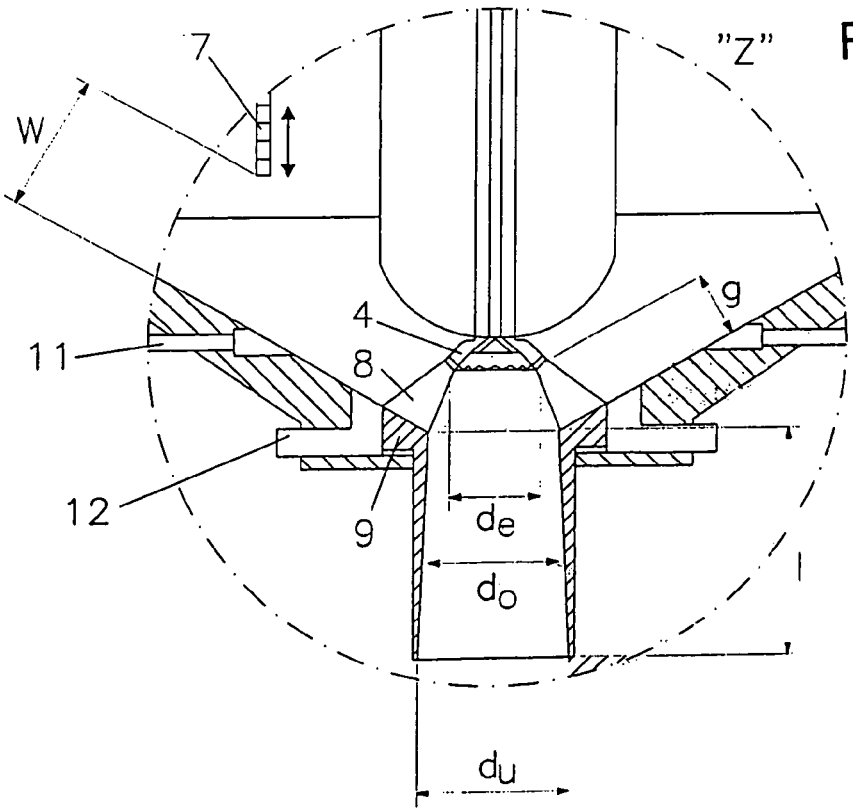
FIG. 2 shows the reaction area and the surrounding area as well as the tailback tube in an enlarged representation.

The material to be fragmented is moved by vibration via the movably supported tube 5, that is a jarring structure, from the material receiving funnel into the barrel-like reaction chamber 1 of sheet metal. The amount of the material supplied is adjustable by the intensity of the vibration or jarring drive 6. In order to avoid excessive filling of the reaction chamber 1, but also to protect the high voltage electrode 3 and the isolator 2 thereof, a baffle 7 is installed in the reaction chamber in a height-adjustable manner. With the adjustable passage way w between the lower edge of the baffle 7 and the funnel-shaped wall of the reaction chamber 1, the height of the filling of the material to be processed in the reaction chamber above the reaction zone 8 is limited independently of the action of the jarring device 6 of the material transport. As a result, the residence time of the material before processing is reduced. The limitation of the overall amount of material in the reaction chamber 1 is also important in case of the need for repair work.

The plate-like shaped end 4 of the high voltage electrode 3 with the mean diameter $d_e$ of the front end thereof forms an annular gap of the width g with the opposite funnel-like ground electrode 9. The high voltage discharges occur preferably at the locations of the highest field strength, that is, between the end 4 of the high voltage electrode 3, a mineral lump having a relatively low dielectric constant $E_r$ which is in contact with the end 4 of the high voltage electrode 3 in the process liquid, which is in this case water, and the reaction chamber 1, which is on ground potential. With the spatially and time-wise statistical contact of the fragmentation material with the electrodes 4 and 9, also the HV-discharges occur statistically distributed over the circumference of the electrodes 4, 9.

The supply and discharge of the process liquid required for the electro-dynamic fragmentation—usually water—occurs via openings 11, 12 in the bottom of the reaction container.

Above the reaction zone 8, sufficient material to be fragmented is contained in the reaction chamber 1 and the material flow through this zone is geometrically not delimited; also the pulse generator/electric energy storage should be sufficiently large. Then the average residence time $T_x$ of the material in the reaction zone is determined by way of the speed of the material removal through the tailback tube 9. The tailback tube 9 is highly conical in its area opposite the high voltage electrode 3 where it has a circular cross-section and becomes wider downwardly in a slightly conical manner. The entrance from the reaction zone 8 into the tailback tube has a smaller open width $d_o$ and therefore the circular inlet area $A_o$ and the outlet have a greater open width $d_u$ with a correspondingly larger discharge area $A_u$. The unloading speed $v_0$ or respectively, the transport rate dV/dt out of the reaction zone 8 is determined—as a result of the adjustable distance a between the outlet of the tailback tube 9 and the transport unit 10, which in this case is a transport belt, which moves with the adjustable speed $v_o$—by the blocking action of the material disposed on the transport belt 10. The length 1 of the tailback tube 9 is so selected that, under water and in spite of the vibrations caused by the fragmentation process, a stable angle of repose is formed on the transport belt 10. Under these conditions, the average number n of high voltage pulses, which act on the amount m of the material passing through the reaction zone, is determined by distance a between the outlet of the tailback-tube 9 and the transport belt $10^{-Vo}$ and by the pulse frequency f of the high voltage pulses. By way of these parameters the fragmentation degree of the material passing through the reaction zone is controlled. With constant tailback parameters an increase/reduction of the pulse frequency f results in an increase/reduction in the fragmentation. When the capacity limits of the pulse generator are reached or when the electrode distance g and/or the diameter $d_o$ of the tailback high voltage electrode-facing section of the tailback tube become limiting factors, the tailback parameters must be adapted that is the distance a between the outlet of the tailback-tube 9 and transport unit 10 and/or the speed $v_o$ of the latter must be reduced.

REFERENCES

[1] Hammon J. et al. "Electric pulse rock sample disintegrator", Proc. 28$^{th}$ IEEE Int. Conf. on Plasma Science and 13$^{th}$ IEEE Int. Pulsed Power Conf. (PPPS-2001), Las Vegas, USA, Jun. 17-22, 2001, pp 1142-1145.

[2] Andres J. in: Int. Journal of Mineral Processing, 4 (1977) 33-38.

What is claimed is:

1. Process reactor for the electro-dynamic fragmentation of lumpy mineral materials by pulsed high voltage discharges, comprising:

a reaction chamber (1) with a funnel-like bottom with a central outlet, a high-voltage electrode (3) which extends from the top into the reaction chamber (1) and to which a high voltage can be applied, the high-voltage electrode (3) being surrounded by an electric insulator (2), the high voltage electrode (3) being movable along the axis thereof so that its end is disposed opposite the central outlet where another electrode (9) which is at an electric reference potential is disposed at a variable distance from the high voltage electrode (3), the outlet at the funnel-like bottom converging into a tailback tube (9) below which a transport unit (10) is disposed for the removal of the processed fragmented material sinking down through the tailback tube (9), a material supply arrangement (5) extending to an opening in the wall of the reaction chamber (1) by way of which material to be fragmented is introduced into the reaction chamber (1), and a material flow blocking structure (7) disposed in the reaction chamber (1) in front of the material inlet opening for controlling the material admission and the fill level in the reaction container (1).

2. A process reactor according to claim 1, wherein the central outlet at the funnel-like bottom is a metallic tailback tube (9) of the length l with an upper open width $d_o$ and a lower open width $d_u$ wherein $d_o<d_u$, and which has a conical edge and joins the conical part of the funnel-like bottom snugly and smoothly and forms the other electrode with the electric reference potential, the wall disposed on the funnel-like bottom of the reaction chamber (1) being also metallic and this wall and the tailback tube being at a common electric potential, that is, the reference potential.

3. A process reactor according to claim 2, wherein the high voltage electrode (3) consists of an electrically conductive metal with low burn off properties, outside the reaction chamber an insulating hose is connected to the high voltage electrode for supplying cooling water thereto, at its end opposite the reference potential electrode (9), the high voltage electrode (3) is funnel-like widened, and the front end with the diameter $d_e$ being disposed opposite the conical opening of the tailback tube 9 so as to form an annular gap of constant width g between the high voltage electrode (3) and the reference potential electrode (9) and in this way, forming the conical annular reaction zone (8) for the fragmentation.

4. A process reactor according to claim 3, wherein the high voltage electrode (3) is one of a solid cylindrical and hollow cylindrical shape and has one of a round and polygonal cross-section.

5. A process reactor according to claim 4, wherein the material supply unit is a conveyor belt (10).

6. A process reactor according to claim 5, wherein the material flow blocking structure (7) is a height-adjustable baffle plate.

7. A process reactor according to claim 5, wherein the material flow blocking structure (7) consists of a group of at least one of chutes and tubes extending circumferentially along the inner wall of the reaction chamber in a horizontal or helical fashion, wherein openings are provided along the bottom line of the chutes or tubes and a downpipe extends from each opening with an open diameter of the opening, and the down-pipes extend adjacent the reactor wall downwardly and end in close proximity of the reactor bottom.

8. A Process reactor according to claim 1, wherein the transport unit (10) for the removal of the material is a conveyor disc.

9. Process reactor according to claim 1, wherein the transport unit (10) for the removal of the material is a vibrating conveyor belt.

10. Process reactor according to claim 1, wherein the annular front end of the high voltage electrode (3) has a smooth surface which is so shaped that, local increases of the electric field are generated.

* * * * *